United States Patent [19]

Whitley, II

[11] Patent Number: 4,825,905

[45] Date of Patent: May 2, 1989

[54] SPLASH RESISTANT GAS VENT

[75] Inventor: Warwick M. Whitley, II, Panama City, Fla.

[73] Assignee: Attwood Corporation, Lowell, Mich.

[21] Appl. No.: 216,273

[22] Filed: Jul. 8, 1988

[51] Int. Cl.[4] ..... F16K 24/04

[52] U.S. Cl. ..... 137/587; 220/372; 220/DIG. 27; 440/88

[58] Field of Search ..... 137/587; 220/369, 370, 220/371, 372, DIG. 27; 440/88, 89; 114/211

[56] References Cited

U.S. PATENT DOCUMENTS

| | | | |
|---|---|---|---|
| 924,587 | 6/1909 | Sharp | 220/367 X |
| 1,350,109 | 8/1920 | Nystrom | 220/373 |
| 1,851,084 | 3/1932 | Brown et al. | 220/367 X |
| 2,262,018 | 11/1941 | Lighton | 220/367 X |
| 2,314,963 | 3/1943 | Zelnis | 220/373 X |
| 2,601,820 | 7/1952 | Paul et al. | 98/122 |
| 2,644,609 | 7/1953 | Foss | 220/374 X |
| 2,644,610 | 7/1953 | Work | 220/367 X |
| 3,064,668 | 11/1962 | Alkire et al. | 137/43 |
| 3,103,870 | 9/1963 | Steiner | 114/211 |
| 3,128,899 | 4/1964 | Runo | 220/374 |
| 3,356,249 | 12/1967 | Koester | 220/367 X |
| 3,403,809 | 10/1968 | Kennedy et al. | 220/367 |
| 3,515,305 | 6/1970 | Weber et al. | 220/372 |
| 3,866,789 | 2/1975 | Lambert | 220/373 X |
| 3,902,632 | 9/1975 | Baker et al. | 220/372 |
| 3,916,724 | 11/1975 | Muller et al. | 74/606 R |
| 4,142,470 | 3/1979 | Zauss | 220/373 X |
| 4,147,096 | 4/1979 | Caswell | 98/40.24 |
| 4,353,318 | 10/1982 | Williams | 114/211 |
| 4,506,562 | 3/1985 | Yamaura et al. | 74/606 R |
| 4,589,852 | 5/1986 | Price | 440/89 |
| 4,595,118 | 6/1986 | Azuma et al. | 220/374 |
| 4,706,840 | 11/1987 | Thompson | 220/373 |

*Primary Examiner*—John Rivell

*Attorney, Agent, or Firm*—Price, Heneveld, Cooper, DeWitt & Litton

[57] ABSTRACT

A splash resistance gas vent for venting the fuel tank of a boat includes a body having a bore extending therethrough and a baffle positioned perpendicular to the bore. An annular opening is provided around the baffle and a sloping deflection surface is provided in alignment with the opening and around the bore. A surface between the deflection surface and the opening conducts water entering the opening back out the opening. Additional means, such as a screen mesh over the bore and an enlarged portion of the bore, further inhibit water from entering the fuel tank.

18 Claims, 1 Drawing Sheet

SPLASH RESISTANT GAS VENT

BACKGROUND OF THE INVENTION

This invention relates to a gas vent and in particular to such vent for venting fumes from the fuel tank on a boat.

In order to safely vent fumes developed in the fuel storage tank on a boat to atmosphere, it is necessary to extend a passage to an external portion of the boat. Because of the environment in which a boat operates, it is necessary to prevent water splashing about the externally mounted gas vent from finding a path to the gasoline tank where it would become mixed with the fuel.

While gas vents are known in the art, such vents are not always adequately splash resistant and thus are not suitable for use on a boat. Additionally, many such prior art gas vents are of a complicated design which requires expensive tooling and assembly labor. Further, the gas vents in the prior art that are designed for substantially horizontal orientation typically require a particular radial orientation within a mounting opening. If the orientation is wrong, then the vent does not function properly.

Accordingly, it is an object of the present invention to provide a gas vent for a boat which is effective in discharging fumes to atmosphere and precluding the admission of water to the fuel tank. It is a further object of the invention to provide such a gas vent which, although it is configured to be substantially horizontally oriented, may be positioned in any radial orientation within an opening without affecting the superior performance of the splash resistant vent. It is yet a further object of the invention to provide such a splash resistant vent for a boat which is inexpensive to manufacture and assemble.

SUMMARY OF THE INVENTION

A splash resistant gas vent according to the invention has a body having a bore extending therethrough and a baffle positioned adjacent a first portion of the body and perpendicular to and aligned with the axis of the bore. The baffle is spaced from the bore and an annular opening is defined substantially entirely around the baffle. Deflection means are provided around the bore axially aligned with the annular opening for deflecting a substance, such as water, passing through the opening away from the bore and conducting means for conducting the water deflected by the deflective means back to the opening to be discharged from the vent by gravity.

These and other related objects, advantages, and features of this invention will become apparent upon review of the following specification in conjunction with the drawings.

DESCRIPTION OF THE PREFERRED EMBODIMENT

Figure 1:
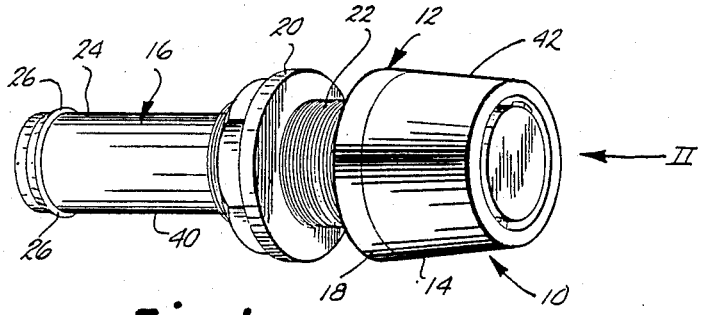
FIG. 1 is a perspective view taken from the front and side of a splash resistant gas vent according to the invention.

Referring now specifically to the drawings, and the illustrative embodiments depicted therein, a splash resistant gas vent generally shown at 10 has a body 12 having an external portion 14, which will extend external to a substantially vertical portion of a boat hull 15 to which the vent is mounted, and a tubular inner portion 16 which will extend internal of the boat hull. External portion 14 includes a mounting flange 18 and a cover member 42. A nut 20 is threadably engageable with a threaded surface 22 on inner portion 16 such that gas vent 10 may be mounted to the vertical mounting wall by extending inner portion 16 through an opening in the mounting wall and threadably engaging nut 20 with surface 22 in order to engage the mounting wall between nut 20 and flange 18. A distal portion 24 of inner portion 16 includes an annular barb 26 to frictionally retain a flexible hose or tube (not shown) extending from the fuel tank of a boat.

Figure 3:
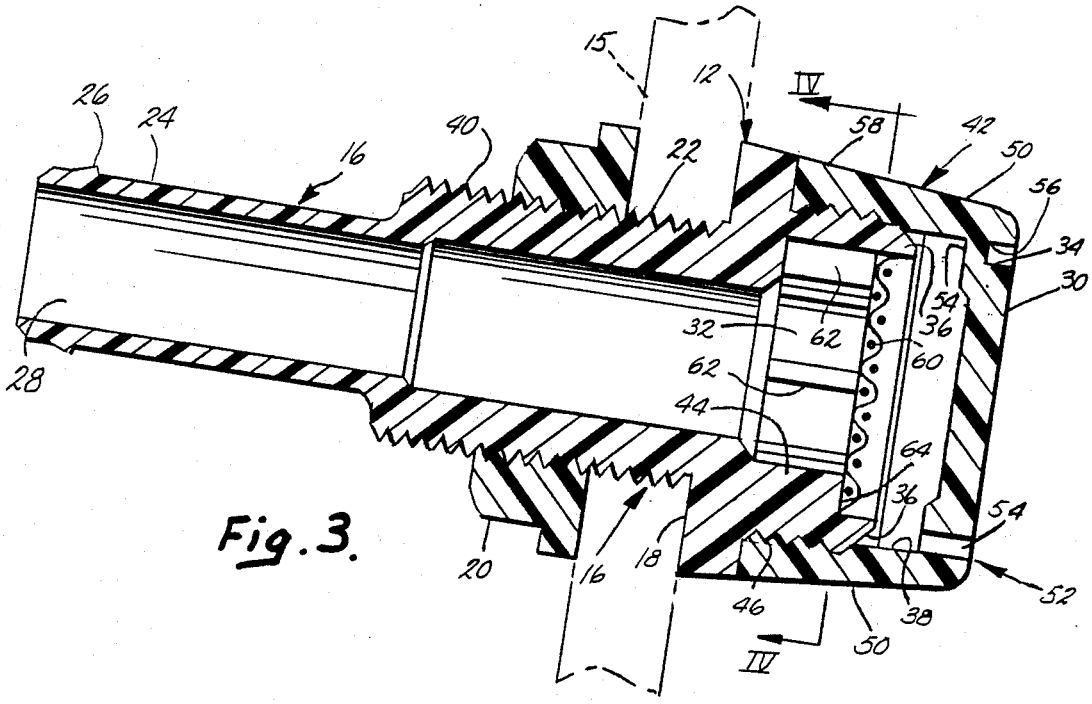
FIG. 3 is a sectional view taken along the lines III—III in FIG. 2.
Figure 4:
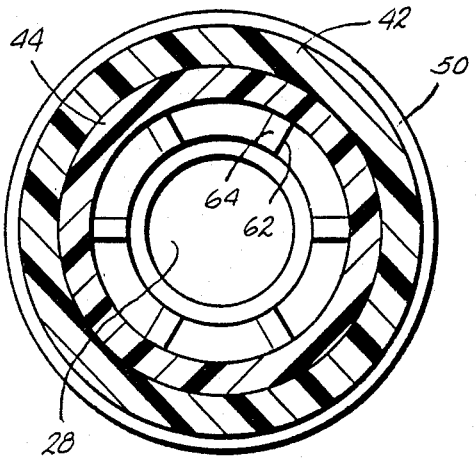
FIG. 4 is a sectional view taken along the lines IV—IV in FIG. 3.
Figure 2:
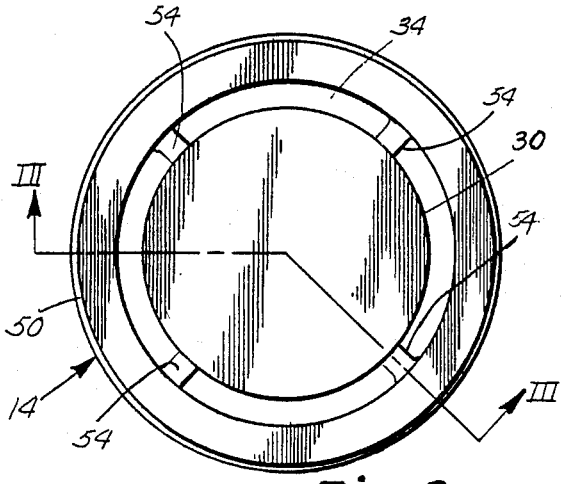
FIG. 2 is a side elevational view of the front, or outward, end of the splash resistant gas vent shown in FIG. 1.

An axial bore 28 is defined extending through body 12 and a baffle 30 is positioned in axial alignment with and spaced outwardly from an outer portion 32 of bore 28 (FIG. 3). An annular opening 34 extends substantially entirely around baffle 30 and provides a passage between bore 28 and the atmosphere. A surface 36 which slopes away from outer portion 32 of bore 28 provides deflecting means for deflecting a substance, such as water, entering opening 34, away from axial bore 28. A surface 38 extending between the lateral outermost portion of sloping surface 36 and opening 34 provides conducting means for conducting water deflected by sloping surface 36 back out opening 34 by gravity to prevent such water from accumulating within the vent.

Body 12, in the illustrated embodiment, is made from two members which may be individually injection molded from a resinous plastic material. Body 12 includes a base member 40 and cover member 42 interfaced with base member 40. Base member 40 includes a mounting portion defined by annular flange 18 and tubular inner portion 1 extending rearwardly from flange 18. Base member 40 further includes a forward portion 44 integral with and extending forwardly of flange 18. Forward portion 44 includes a threaded annular outer surface 46 and sloping surface 36 extending forwardly of and sloping laterally inwardly, forwardly of outer surface 46. In the illustrated embodiment, sloping surface 36 provides the deflecting means for deflecting substances passing through the opening 34 away from the outer portion 32 of bore 28.

Cover member 42 includes an annular wall 50 and attachment means generally shown at 52 for attaching baffle 30 to an outer portion of annular wall 50. In the illustrated embodiment, attachment means 52 includes a plurality of spokes 54 extending between a laterally outer portion of baffle 30 and an inner surface 56 of wall 50. While four spokes are illustrated, a greater or lesser number would be suitable. In a most preferred embodiment, inner surface 56 has substantially the same diameter as outer surface 46 of base member 40 and has threads engageable with the threads on outer surface 46. In this manner, cover member 42 may be attached to base member 40 by juxtaposing the axially-inner portion of surface 56 with surface 46 and rotating cover member 42 with respect to base member 40 until an inner portion 58 of annular wall 50 engages with flange 18. In this most preferred embodiment, inner surface 56 is positioned laterally outwardly of deflecting surface 36 and extends between surface 36 and opening 34. Thus, inner surface 56 defines conducting mean surface 38 for conducting substances, such as water, deflected by the sloping surface 36 back out through opening 34. Also, the threadable engagement between surfaces 46 and 56 allows removal of cover member 42 if it becomes necessary to remove debris from behind baffle 30. However, the invention additionally comprehends engagement of surfaces 46 and 56 by a more permanent means, such as by a suitable adhesive.

In the illustrated embodiment, a screen 60 is positioned across outer portion 32 of bore 28 in order to provide additional means for deflecting substances away from bore 28 and to prevent insects and other solid matter from entering bore 28. In order to support screen 60, a plurality of ribs 62 are spaced radially around outer portion 32 and each includes an outwardly facing land 64.

Splash resistant gas vent 10 is assembled by placing screen 60 over lands 64 and by threadably engaging cover 42 with base member 40. The vent 10 is installed on a boat by extending inner portion 16 through a mounting opening, threading nut 20 onto threaded surface 22 to mount the vent and extending a hose between distal portion 24 and the boat fuel tank. Fumes from the fuel are well vented through bore 28 and the large annular opening 34. Any water splashed against gas vent 10 may enter opening 34 but will be deflected laterally outwardly by sloping surface 36 and returned by gravity along inner surface 38 and back out opening 34. Screen 60 provides additional deflecting means to further deflect splashes of water that may get past the sloping surface 36 away from outer portion 32. Because outer bore portion 32 is of greater diameter than the remainder of bore 28, water getting past screen 60 will tend to be retained in outer portion 32 and returned by gravity through screen 60 and surface 38 out opening 34 in order to inhibit water from further traversing the bore and entering the fuel tank.

Changes and modifications in the specifically described embodiments can be carried out without departing from the principals of the invention which is intended to be limited only by the scope of the appended claims, as interpreted according to the principals of patent law, including the doctrine of equivalents.

The embodiments of the invention of which an exclusive property or privilege is claimed are defined as follows:

1. A gas vent comprising:

a body having a first portion, and a bore extending through said body and traversing said portion;

a baffle positioned adjacent said first portion and perpendicular to and aligned with the axis of said bore, said baffle spaced from said bore;

means defining an annular opening substantially entirely around said baffle;

deflection means around said bore and axially aligned with said opening for deflecting a substance passing through said opening away from said bore; and conducting means between said deflection means and said opening for conducting substances deflected by said deflection means to said opening to be discharged from said vent, whereby said vent will discharge substances passing through said opening regardless of the radial orientation of said bore.

2. The vent in claim 1 in which said conducting means comprises an annular surface extending between said deflection means and said opening.

3. The vent in claim 2 in which said annular surface is laterally spaced from said baffle defining said annular opening.

4. The vent in claim 1 in which said deflection means comprises an annular surface around said bore at a terminal end thereof, said annular surface sloping laterally away from said bore.

5. The vent in claim 1 further including a second deflective means over said bore for deflecting a substance approaching said bore.

6. The vent in claim 5 in which said second deflection means comprises a screen mesh covering said bore.

7. The vent in claim 5 further including inhibiting means in said bore for inhibiting a substance entering said bore from further traversing said bore.

8. The vent in claim 7 in which said inhibiting means comprises an outer portion of said bore having a diameter larger than the rest of said bore.

9. The vent in claim 6 having inhibiting means in said bore for inhibiting a substance entering said bore from traversing said bore.

10. The vent in claim 9 in which said inhibiting means comprises an outer portion of said bore having a diameter larger than the rest of said bore.

11. The vent in claim 10 further including ribs in said outer portion having axially forward lands for supporting said screen mesh.

12. A gas vent comprising:

a base member with means defining a bore therethrough, said base member having a mounting portion and a tubular portion extending from said mounting portion, said mounting portion including an annular flange and a forward portion extending from said flange opposite said tubular portion, said forward portion including an annular outer surface and a sloping annular forward surface extending forwardly and sloping inwardly forwardly of said outer surface;

a cover member including an annular wall, a baffle member and attachment means for attaching said baffle to a forward portion of said annular wall, said wall having an inner surface configured to interface with said base member outer surface and said baffle member being smaller than the area enclosed by said inner surface defining an annular opening around said baffle substantially aligned with said base member sloping surface, whereby said sloping surface will deflect a substance entering said opening away from said bore and said inner surface will conduct such substance back to said opening.

13. The vent in claim 12 in which said attachment means comprises a plurality of spokes extending between said wall and said baffle.

14. The vent in claim 12 further including a screen inside of said forward surface covering said bore.

15. The vent in claim 14 including ribs on said base member extending inwardly in said bore and having forward facing lands for supporting said screen.

16. The vent in claim 12 including a threaded surface on said tubular portion and a nut configured to threadably engage said threaded surface to retain a mounting surface between said nut and said mounting portion.

17. The vent in claim 12 including means on said tubular portion for engaging a tubular member.

18. The vent in claim 12 in which said base member outer surface and said cover member inner surface are threadably interfaced.

* * * * *